US011107443B2

(12) United States Patent
Kim

(10) Patent No.: US 11,107,443 B2
(45) Date of Patent: Aug. 31, 2021

(54) FOLDABLE DISPLAY DEVICE AND DRIVING METHOD OF THE SAME

(71) Applicant: Samsung Display Co., Ltd., Yongin-si (KR)

(72) Inventor: Wontae Kim, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/585,898

(22) Filed: Sep. 27, 2019

(65) Prior Publication Data

US 2020/0160817 A1 May 21, 2020

(30) Foreign Application Priority Data

Nov. 20, 2018 (KR) ..... 10-2018-0143147

(51) Int. Cl.
*G09G 5/14* (2006.01)
*G09G 5/00* (2006.01)

(52) U.S. Cl.
CPC ..... *G09G 5/14* (2013.01); *G09G 5/008* (2013.01); *G09G 2310/0243* (2013.01); *G09G 2310/0275* (2013.01); *G09G 2310/0286* (2013.01); *G09G 2310/08* (2013.01); *G09G 2330/023* (2013.01); *G09G 2370/10* (2013.01); *G09G 2380/02* (2013.01)

(58) Field of Classification Search
CPC ..... H05K 1/0296; H05K 3/1275; H05K 2201/09263; G06F 3/041; G06F 2203/04103; G06F 2203/04112; G09G 5/14
See application file for complete search history.

(56) References Cited

U.S. PATENT DOCUMENTS 10,142,547 B2 * 11/2018 Yamazaki ..... G06F 1/1647
10,481,638 B2 * 11/2019 Yoshizumi ..... G06F 1/1643
2012/0235894 A1 * 9/2012 Phillips ..... G09G 3/36 345/156
2014/0118317 A1 * 5/2014 Song ..... G09G 5/14 345/204

(Continued)

FOREIGN PATENT DOCUMENTS

KR 10-2016-0033106 A 3/2016
KR 10-2016-0127281 A 11/2016

(Continued)

*Primary Examiner* — Sejoon Ahn

(74) *Attorney, Agent, or Firm* — Lewis Roca Rothgerber Christie LLP

(57) ABSTRACT

A foldable display device includes a display panel including a first display area and a second display area, a timing controller configured to receive input image data and to provide a first data packet corresponding to the first display area and a second data packet corresponding to the second display area concurrently, and a data driver configured to receive the first data packet and the second data packet, to determine whether the first display area or the second display area is folded based on the first data packet and the second data packet, and to not output a first data signal corresponding to the first data packet or a second data signal corresponding to the second data packet when the first display area or the second display area is folded.

20 Claims, 9 Drawing Sheets

(56) References Cited

U.S. PATENT DOCUMENTS

| | | | | |
|---|---|---|---|---|
| 2015/0009128 | A1* | 1/2015 | Matsumoto | G06F 3/044<br>345/156 |
| 2015/0255016 | A1* | 9/2015 | An | G09G 3/3233<br>345/211 |
| 2017/0316738 | A1* | 11/2017 | Sohn | G09G 3/3225 |

FOREIGN PATENT DOCUMENTS

| | | | |
|---|---|---|---|
| KR | 10-2018-0031886 | A | 3/2018 |
| KR | 10-1872987 | B1 | 7/2018 |

* cited by examiner

FOLDABLE DISPLAY DEVICE AND DRIVING METHOD OF THE SAME

CROSS-REFERENCE TO RELATED APPLICATION

This application claims priority to and the benefit of Korean Patent Application No. 10-2018-0143147, filed on Nov. 20, 2018 in the Korean Intellectual Property Office (KIPO), the content of which is incorporated herein in its entirety by reference.

BACKGROUND

1. Field

Example embodiments relate generally to a foldable display device and a driving method of the same.

2. Description of the Related Art

Recently, flat panel display (FPD) devices are widely used as a display device of electronic devices because FPD devices are relatively lightweight and thin compared to cathode-ray tube (CRT) display devices. Examples of FPD devices are liquid crystal display (LCD) devices, field emission display (FED) devices, plasma display panel (PDP) devices, and organic light emitting display (OLED) devices.

A foldable display device using a flexible display panel has been developed. The foldable display device can be folded or unfolded, so that the foldable display device is more portable. When the foldable display device is folded, there may be a problem that power consumption is increased by displaying an image in a folded area as well as an area viewed by a user.

SUMMARY

Some example embodiments provide a foldable display device capable of decreasing power consumption.

Some example embodiments provide a driving method of a foldable display device capable of decreasing power consumption.

According to an aspect of example embodiments, a foldable display device includes a display panel including a first display area and a second display area, a timing controller configured to receive input image data and to provide a first data packet corresponding to the first display area and a second data packet corresponding to the second display area concurrently, and a data driver configured to receive the first data packet and the second data packet, to determine whether the first display area or the second display area is folded based on the first data packet and the second data packet, and to not output a first data signal corresponding to the first data packet or a second data signal corresponding to the second data packet when the first display area or the second display area is folded.

In example embodiments, the data driver may include a first receiver configured to receive the first data packet and to detect whether the first display area is folded based on the first data packet, a second receiver configured to receive the second data packet and to detect whether the second display area is folded based on the second data packet, a first shift register configured to output first pulses based on the first data packet, and a second shift register configured to output second pulses based on the second data packet.

In example embodiments, the first receiver may include a pattern detector configured to detect a pattern of the first data packet and a folding control signal generator configured to determine whether the first display area is folded based on the pattern of the first data packet and to output a folding control signal based on a folding state of the first display area.

In example embodiments, the folding control signal generator is configured to generate the folding control signal based on the pattern of the first data packet and a folding pattern.

In example embodiments, the first receiver may include a switch coupled between an analog front end (AFE) block and a power line through which a power signal is provided.

In example embodiments, the first shift register may include a switch coupled between a clock data recovery (CDR) block and a power line through which a power signal is provided.

In example embodiments, the second receiver may include a pattern detector configured to detect a pattern of the second data packet and a folding control signal generator configured to determine whether the second display area is folded based on the pattern of the second data packet and to output a folding control signal based on a folding state of the second display area.

In example embodiments, the folding control signal generator is configured to generate the folding control signal based on the pattern of the second data packet and a folding pattern.

In example embodiments, the second receiver may include a switch coupled between an analog front end (AFE) block and a power line through which a power signal is provided.

In example embodiments, the second shift register may include a switch coupled between a clock data recovery (CDR) block and a power line through which a power signal is provided.

In example embodiments, the data driver may further include a black data generator configured to generate a black data signal corresponding to black color, a first switch block configured to couple the black data generator to data lines in the first display area when the first display area is folded, and a second switch block configured to couple the black data generator to data lines in the second display area when the second display area is folded.

In example embodiments, the first switch block and the second switch block are configured to turn on or turn off in response to the folding control signal.

In example embodiments, the black data signal may be provided to the data lines in the first display area when the first display area is folded, and the black data signal may be provided to the data lines in the second display area when the second display area is folded.

According to an aspect of example embodiments, a driving method of a foldable display device may include receiving a first data packet and a second data packet concurrently, determining whether a first display area or a second display area of a display panel is folded, not outputting a first data signal corresponding to the first data packet when the first display area is folded, and not outputting a second data signal corresponding to the second data packet when the second display area is folded.

In example embodiments, the determining whether the first display area of the display panel is folded may include detecting a pattern of the first data packet based on the first data packet.

In example embodiments, the determining whether the second display area of the display panel is folded may include detecting a pattern of the second data packet based on the second data packet.

In example embodiments, the not outputting the first data signal corresponding to the first data packet may include blocking a power signal provided to a first receiver that receives the first data packet or to a first shift register coupled to the first receiver.

In example embodiments, the not outputting the second data signal corresponding to the second data packet may include blocking a power signal provided to a second receiver that receives the second data packet or to a second shift register coupled to the second receiver.

In example embodiments, the not outputting the first data signal corresponding to the first data packet may further include providing a black data signal corresponding to black color to data lines in the first display area.

In example embodiments, the not outputting the second data signal corresponding to the second data packet may further include providing a black data signal corresponding to black color to data lines in the second display area.

Therefore, the foldable display device and a driving method of the foldable display device may determine whether the first display area or the second display area is folded based on the first data packet and the second data packet and not output the first data signal corresponding to the first data packet or the second data signal corresponding to the second data packet when the first display area or the second display area is folded. Thus, power consumption of the foldable display device may be reduced.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Hereinafter, the present inventive concept will be explained in detail with reference to the accompanying drawings.

Figure 1:
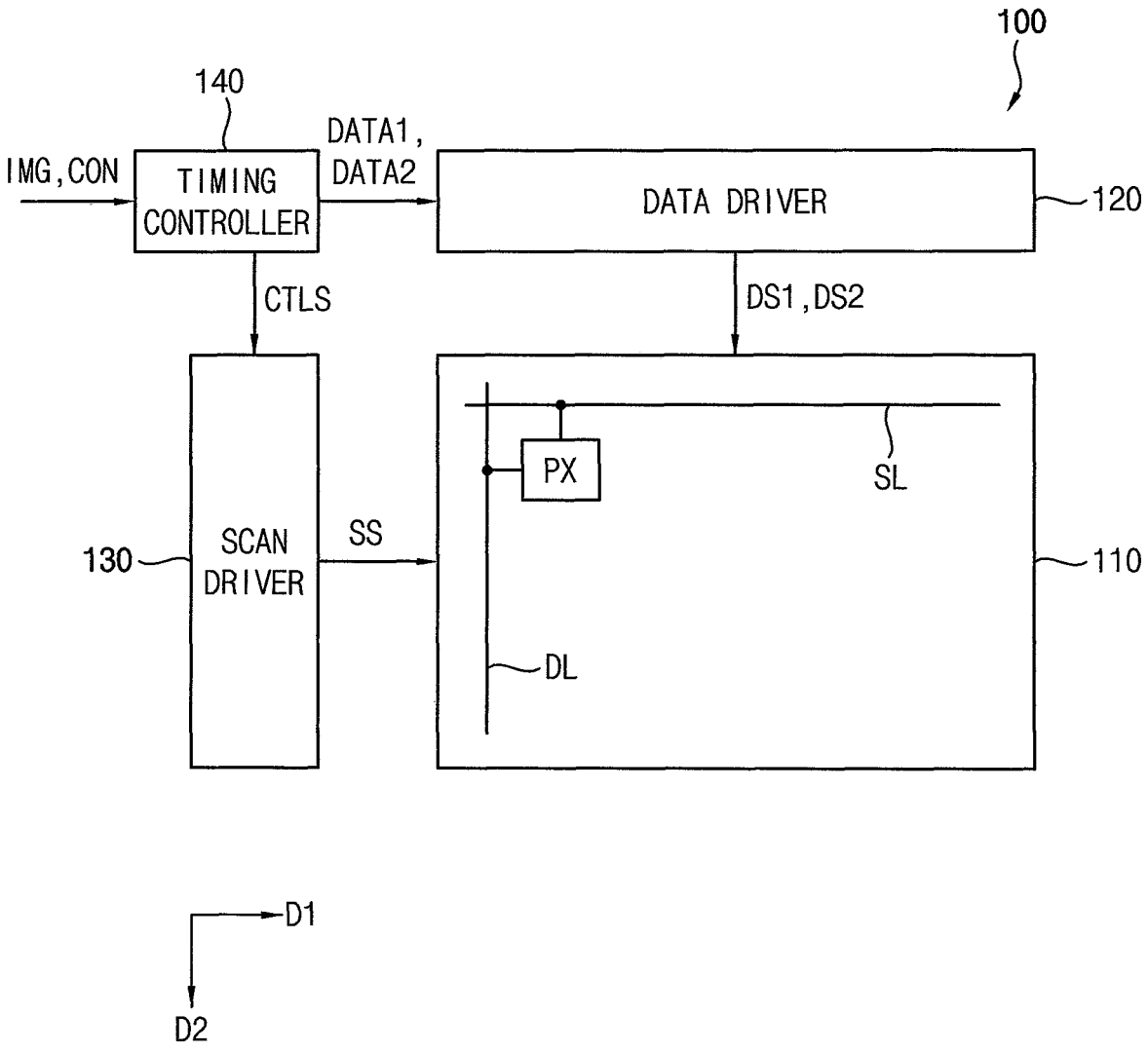
FIG. 1 is a block diagram illustrating a foldable display device according to example embodiments.

FIG. 1 is a block diagram illustrating a foldable display device according to example embodiments.

Referring to FIG. 1, a foldable display device 100 according to exemplary embodiments includes a display panel 110, a timing controller 140, a data driver 120, and a scan driver 130.

The display panel 110 includes data lines DL, scan lines SL, and a plurality of pixels PX. The scan lines SL may extend in a first direction D1 and be arranged along a second direction D2 perpendicular to the first direction D1. The data lines DL may extend in the second direction D2 and be arranged along the first direction D1. The first direction D1 may be parallel with a long side of the display panel 110, and the second direction D2 may be parallel with a short side of the display panel 110. Each of the pixels PX may be located at a crossing region of the data lines DL and the scan lines SL.

The display panel 110 may include a first display area and a second display area. The display panel 110 may include a folding area in an area overlapping the first display area and the second display area. The display panel 110 may be bent or folded based on the folding area. In this case, a user may view only one of the first display area and the second display area. The foldable display device 100 according to example embodiments may determine whether the display panel 110 is folded and may not output a data signal provided to the folded area to reduce power consumption of the foldable display device 100. Hereinafter, the foldable display device 100 will be described in detail.

The timing controller 140 may receive input image data IMG and provide a first data packet DATA1 corresponding to the first display area and a second data packet DATA2 corresponding to the second display area concurrently (e.g., simultaneously or at the same time).

The timing controller 140 may receive the input image data IMG and an input control signal CON. The timing controller 140 may generate the first data packet DATA1 corresponding to the first display area and the second data packet DATA2 corresponding to the second display area based on the input image data IMG. The timing controller 140 may generate the first data packet DATA1 and the second data packet DATA2 by applying an algorithm for compensating display quality of the input image data IMG. Alternatively, the timing controller may generate the first data packet DATA1 and the second data packet DATA2 by not applying the algorithm for compensating the display quality of the input image data IMG. The timing controller 140 may provide the first data packet DATA1 to the data driver 120 through a first port and may provide the second data packet DATA2 to the data driver 120 through a second port. The timing controller 140 may generate a scan control signal CTLS based on the input control signal CON. For example, the scan control signal CTLS may include a vertical start signal and a clock control signal. The first data packet DATA1 and the second data packet DATA2 may be a signal in which a clock signal in the input control signal CON is embedded.

The data driver 120 may receive the first data packet DATA1 and the second data packet DATA2, determine whether the first display area or the second display area is folded based on the first data packet DATA1 and the second data packet DATA2, and not provide a first data signal DS1 corresponding to the first data packet DATA1 or a second data signal DS2 corresponding to the second data packet DATA2 when the first display area or the second display area is folded.

The data driver 120 may receive the first data packet DATA1 through the first port and the second data packet DATA2 through the second port. The data driver 120 may determine whether the first display area or the second display area is folded based on the first data packet DATA1 and the second data packet DATA2. In some example embodiments, the data driver 120 may detect a pattern of an image displayed on the first display area based on the first data packet DATA1 and may determine that the first display area is folded when the first data packet DATA1 includes a set or predetermined folding pattern. Further, the data driver 120 may detect a pattern of an image displayed on the second display area based on the second data packet DATA2 and may determine that the second display area is folded when the second data packet DATA2 includes the set or predetermined folding pattern. The folding pattern may be stored in the data driver 120. The data driver 120 may not output the first data signal DS1 corresponding to the first data packet DATA1 when the first display area is folded. Further, the data driver 120 may not output the second data signal DS2 corresponding to the second data packet DATA2 when the second display area is folded.

The scan driver 130 may generate a scan signal SS based on the scan control signal CTLS provided from the timing controller 140. The scan driver 130 may sequentially output the scan signals SS to the pixels PX. The scan driver 130 may be directly mounted on the display panel 110 or be coupled to the display panel 110 by being implemented as a chip on film (COF).

As described above, the foldable display device 100 according to example embodiments may detect a folding area of the display panel 110 based on the first data packet DATA1 and the second data packet DATA2 and may not output the data signal to the folding area. Thus, the power consumption may be reduced.

Figure 2:
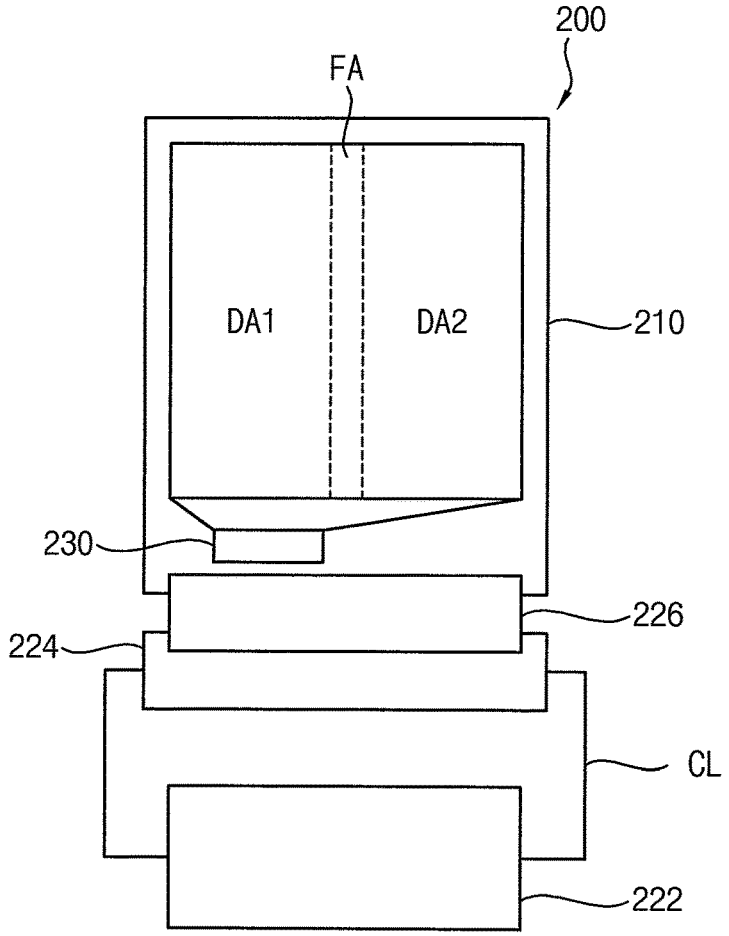
FIG. 2 is a diagram illustrating the foldable display device of FIG. 1 according to exemplary embodiments.

FIG. 2 is a diagram illustrating the foldable display device of FIG. 1, according to example embodiments.

The foldable display device 200 of FIG. 2 may correspond to the foldable display device 100 of FIG. 1.

Referring to FIG. 2, the foldable display device 200 may include a display panel 210, a first printed circuit board (PCB) 222, a second printed circuit board 224, a flexible printed circuit film 226, and a source integrated circuit (IC) 230.

The display panel 210 may include a first display area DA1 and a second display area DA2. The display panel 210 may include a folding area FA in an area overlapping the first display area DA1 and the second display area DA2.

Figure 3:
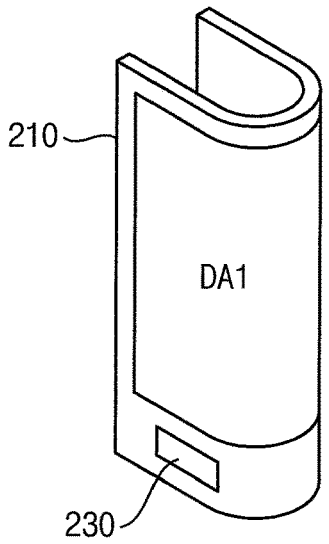
FIG. 3 is a diagram illustrating an example of an operation of the display device of FIG. 2.

Referring to FIG. 3, the display panel 210 may be bent or folded based on the folding area FA.

The first printed circuit board 222 and the second printed circuit board 224 may include a driving chip and driving elements for driving the display panel 210. For example, a timing control chip may be mounted on the first printed circuit board 222 and resistor elements for generating gamma voltages may be mounted on the second printed circuit board 224. The timing control chip may correspond to the timing controller 140 of FIG. 1. Further, a voltage generator for generating power voltages provided to the display panel 210 and the source integrated circuit 230 may be mounted on the first printed circuit board 222 and the second printed circuit board 224. The first printed circuit board 222 and the second printed circuit board 224 may be coupled by a connector CL. The first printed circuit board 222 and the second printed circuit board 224 may receive or provide logic signals or voltages through the connector CL. Although the foldable display device 200 that includes the first printed circuit board 222 and the second printed circuit board 224 is described in FIG. 2, the foldable display device 200 is not limited thereto. For example, the foldable display device 200 may include only one printed circuit board or may further include a third printed circuit board.

The second printed circuit board 224 may be coupled to the display panel 210 through the flexible printed circuit film 226. The flexible printed circuit film 226 may transfer output signals from the second printed circuit board 224 to the display panel 210.

The source integrated circuit 230 may receive the first data packet and the second data packet and generate the first data signal corresponding to the first data packet and the second data signal corresponding to the second data packet. The source integrated circuit 230 of FIG. 2 may correspond to the data driver 120 of FIG. 1. Here, the source integrated circuit 230 may be formed so as not to overlap with the folding area FA. For example, the source integrated circuit 230 may be located on a side of the first display area DA1 or on a side of the second display area DA2.

Figure 4:
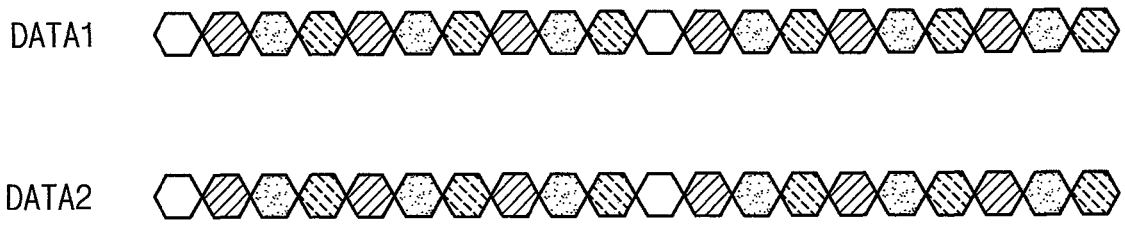
FIG. 4 is a diagram illustrating an example of a first data packet and a second data packet used as an input to a data driver included in the foldable display device of FIG. 1.

FIG. 4 is a diagram illustrating an example of a first data packet and a second data packet used as an input to a data driver included in the foldable display device of FIG. 1.

Referring to FIG. 4, the timing controller 140 may output the first data packet DATA1 and the second data packet DATA2 concurrently (e.g., simultaneously or at the same time). The first data packet DATA1 and the second data packet DATA2 may be differential signals that swing between a high level and a low level. For example, the first data packet DATA1 and the second data packet DATA2 may include data corresponding to a red data signal, a green data signal, and a blue data signal provided to the pixels in the display panel. The data driver may receive the first data packet DATA1 through the first port and the second data packet DATA2 through the second port.

Figure 5A:
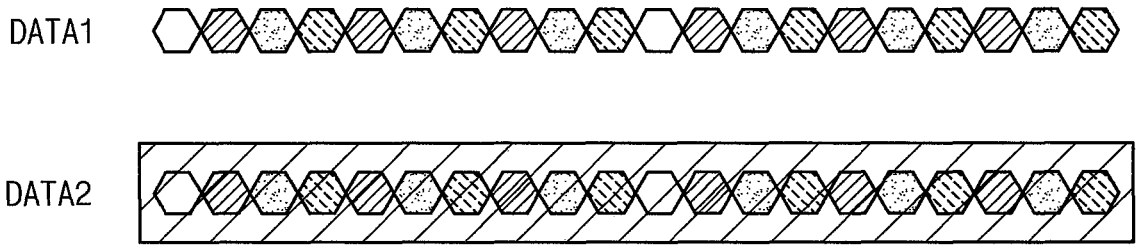
FIGS. 5A and 5B are diagrams illustrating an operation of a data driver included in the foldable display device of FIG. 1.
Figure 5B:
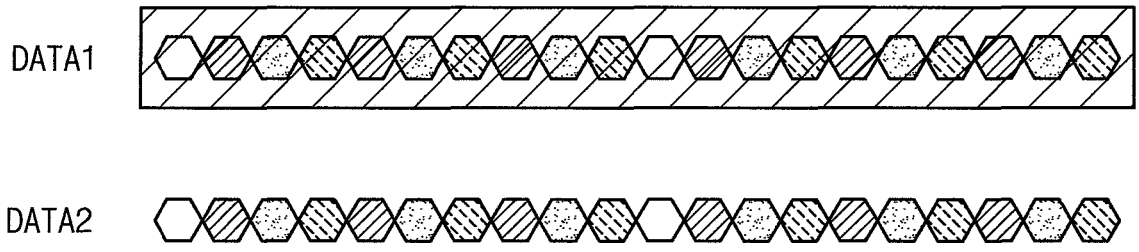

FIGS. 5A and 5B are diagrams illustrating an operation of a data driver included in the foldable display device of FIG. 1.

The data driver 120 may receive the first data packet DATA1 and the second data packet DATA2 from the timing controller 140 and may determine whether the first display area or the second display area is folded based on the first data packet DATA1 and the second data packet DATA2. The data driver 120 may determine that the first display area is folded when the first data packet DATA1 includes a set or predetermined folding pattern. The data driver 120 may determine that the second display area is folded when the second data packet DATA2 includes another set or predetermined folding pattern.

Referring to FIG. 5A, when the data driver 120 determines that the first display area is unfolded and the second display area is folded, a second receiver of the data driver 120 may not output the second data packet DATA2 to a second shift register of the data driver 120. For example, when the second display area is folded, the second receiver of the data driver 120 may block the power signal provided to the second receiver and may not output the second data packet DATA2 to the second shift register of the data driver 120.

Referring to FIG. 5B, when the data driver 120 determines that the first display area is folded and the second display area is unfolded, a first receiver of the data driver 120 may not output the first data packet DATA1 to a first shift register of the data driver 120. For example, when the first display area is folded, the first receiver of the data driver 120 may block the power signal provided to the first receiver and may not output the first data packet DATA1 to the first shift register of the data driver 120.

Figure 6:
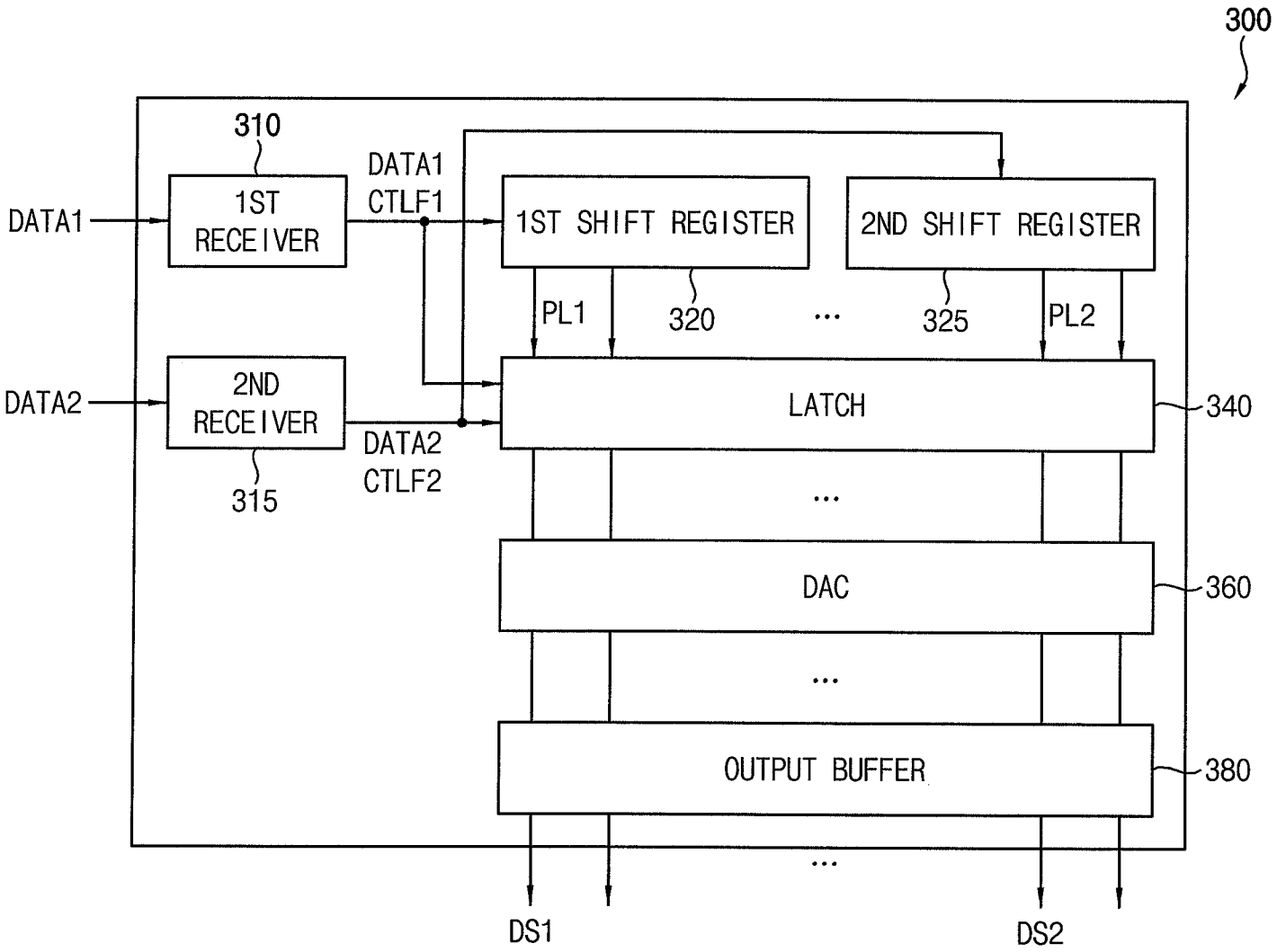
FIG. 6 is a block diagram illustrating a data driver included in the foldable display device of FIG. 1.

FIG. 6 is a block diagram illustrating a data driver included in the foldable display device of FIG. 1, according to example embodiments.

Referring to FIG. 6, a data driver 300 may include a first receiver 310, a second receiver 315, a first shift register 320, a second shift register 325, a latch 340, a digital-to-analog converter (DAC) 360, and an output buffer 380.

The first receiver 310 may receive the first data packet DATA1 from the timing controller (e.g., 140) through the first port. The first receiver 310 may detect a folding state of the first display area based on the first data packet DATA1. The first receiver 310 may detect the pattern of the first data packet DATA1 and may detect the folding state of the first display area based on the pattern of the first data packet DATA1 and a set or predetermined folding pattern. For example, the first receiver 310 may detect the folding state of the first display area by comparing the pattern of the first data packet DATA1 to the set or predetermined folding pattern. The first receiver 310 may output a first folding control signal CTLF1 based on the folding state of the first display area. In some example embodiments, the first receiver 310 may include a switch coupled between an analog front end (AFE) block included in the first receiver 310 and a power line through which a power signal is provided. The first receiver 310 may couple the analog front end block and the power line based on the first folding control signal CTLF1. When the first display area is unfolded, the first receiver 310 may couple the analog front end block and the power line based on the first folding control signal CTLF1. When the first display area is folded, the first receiver 310 may not couple the analog front end block and the power line based on the first folding control signal CTLF1. In this case, the analog front end block may not be driven and the first data packet DATA1 may not be output.

The second receiver 315 may receive the second data packet DATA2 from the timing controller (e.g., 140) through the second port. The second receiver 315 may detect a folding state of the second display area based on the second data packet DATA2. The second receiver 315 may detect the pattern of the second data packet DATA2 and may detect the folding state of the second display area based on the pattern of the second data packet DATA2 and a set or predetermined folding pattern. For example, the second receiver 315 may detect the folding state of the second display area by comparing the pattern of the second data packet DATA2 to the set or predetermined folding pattern. The second receiver 315 may output a second folding control signal CTLF2 based on the folding state of the second display area. In some example embodiments, the second receiver 315 may include a switch coupled between an analog front end block included in the second receiver 315 and the power line through which the power signal is provided. The second receiver 315 may couple the analog front end block and the power line based on the second folding control signal CTLF2. When the second display area is unfolded, the second receiver 315 may couple the analog front end block and the power line based on the second folding control signal CTLF2. When the second display area is folded, the second receiver 315 may not couple the analog front end block and the power line based on the second folding control signal CTLF2. In this case, the analog front end block may not be driven and the second data packet DATA2 may not be output.

The first shift register 320 may output first pulses PL1 based on the first data packet DATA1. The first data packet DATA1 may be the signal in which the clock signal is embedded. The first shift register 320 may include a clock data recovery (CDR) block. The clock data recovery block may generate the first pulses PL1 by synchronizing the clock signal included in the first data packet DATA1. In some example embodiments, the first shift register 320 may include a switch coupled between the clock data recovery block and the power line through which the power signal is provided. The first shift register 320 may couple the clock data recovery block and the power line based on first folding control signal CTLF1 provided from the first receiver 310. When the first display area is unfolded, the first shift register 320 may couple the clock data recovery block and the power line based on the first folding control signal CTLF1. When the first display area is folded, the first shift register 320 may not couple the clock data recovery block and the power line based on the first folding control signal CTLF1.

The second shift register 325 may output second pulses PL2 based on the second data packet DATA2. The second data packet DATA2 may be the signal in which the clock signal is embedded. The second shift register 325 may include a clock data recovery block. The clock data recovery block may generate the second pulses PL2 by synchronizing the clock signal included in the second data packet DATA2. In some example embodiments, the second shift register 325 may include a switch coupled between the clock data recovery block and the power line through which the power signal is provided. The second shift register 325 may couple the clock data recovery block and the power line based on the second folding control signal CTLF2 provided form the second receiver 315. When the second display area is unfolded, the second shift register 325 may couple the clock data recovery block and the power line based on the second folding control signal CTLF2. When the second display area is folded, the second shift register 325 may not couple the clock data recovery block and the power line based on the second folding control signal CTLF2.

The latch 340 may latch the first data packet DATA1 and the second data packet DATA2 in response to the first pulses PL1 and the second pulses PL2, and may output the latched first data packet DATA1 and the latched second data packet DATA2.

The digital-to-analog converter 360 may convert the first data packet DATA1 and the second data packet DATA2 to the first data signal DS1 and the second data signal DS2, each of which is an analog signal based on a gamma reference voltage.

The output buffer 380 may output the first data signal DS1 and the second data signal DS2 to the data lines in the first display area and the second display area.

In some example embodiments, the data driver 300 may further include a black data generator. The black data generator may generate a black data signal corresponding to black color in response to the first folding control signal CTLF1 and the second folding control signal CTLF2. The data driver 300 may include a first switch block coupled between the black data generator and the data lines formed in the first display area and the second switch block coupled between the black data generator and the data lines in the second display area. When the first display area is folded, the data driver 300 may turn on the first switch block in response to the first folding control signal CTLF1. In this case, the black data generator and the data lines in the first display area may be coupled and the black data signal may be output to the data lines in the first display area. When the second display area is folded, the data driver 300 may turn on the second switch block in response to the second folding control signal CTLF2. In this case, the black data generator and the data lines in the second display area may be coupled and the black data signal may be output to the data lines in the second display area.

Figure 7:
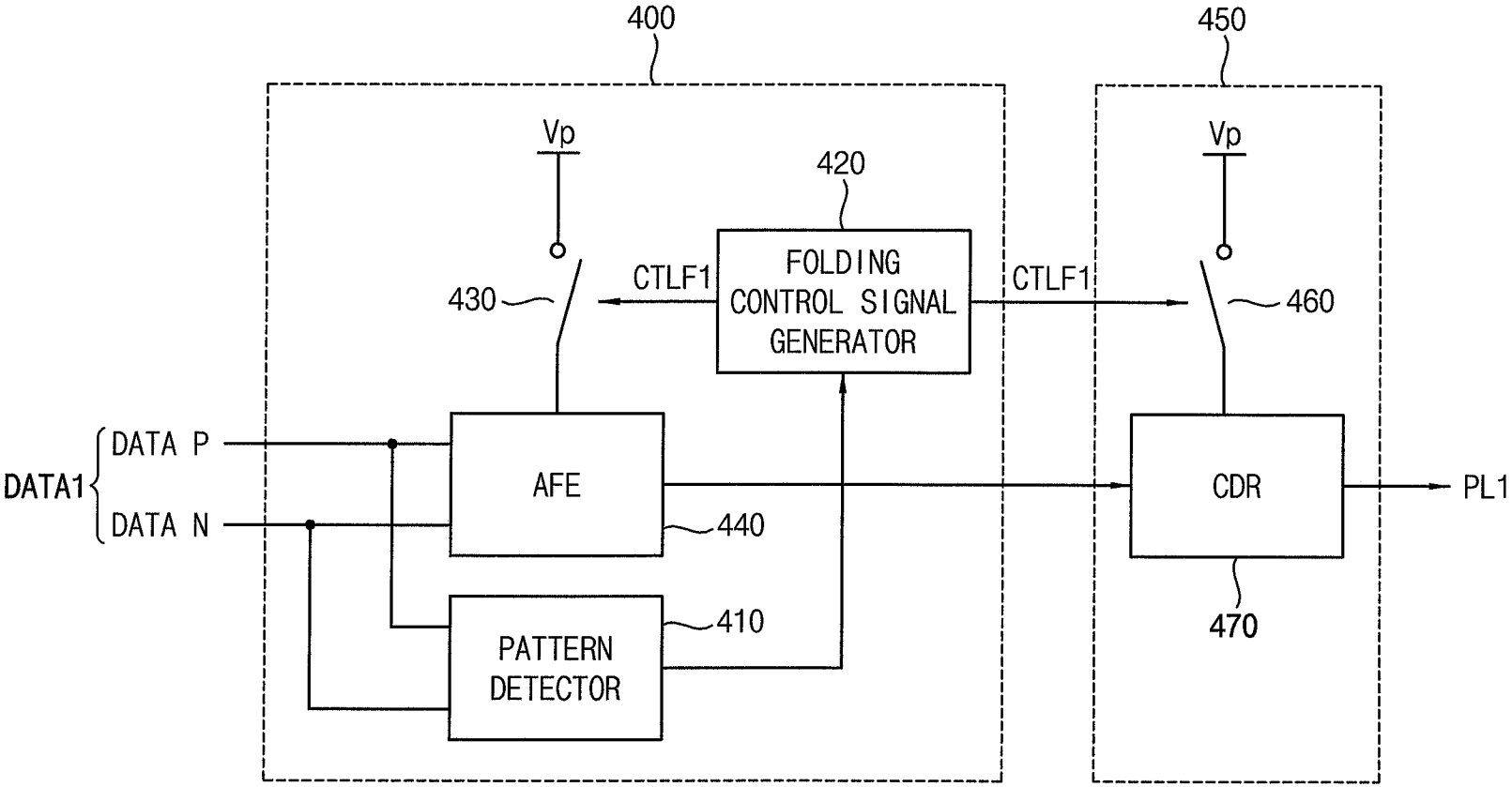
FIG. 7 is a diagram illustrating a first receiver and a first shift register included in the data driver of FIG. 6.
Figure 8:
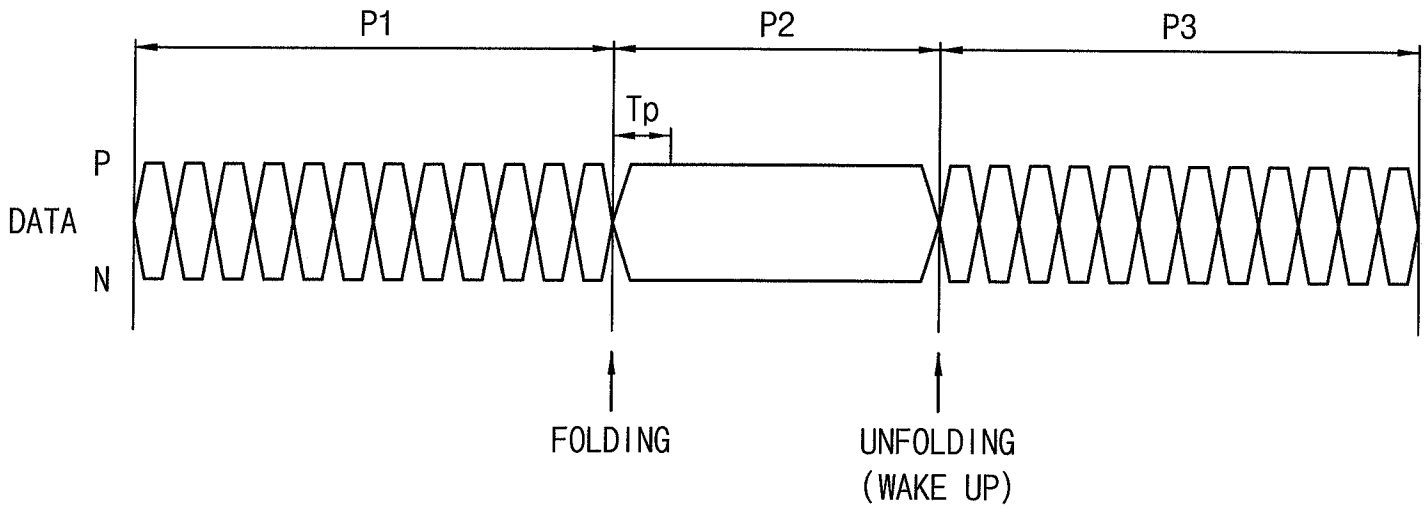
FIG. 8 is a diagram illustrating an operation of the first receiver of FIG. 7.

FIG. 7 is a diagram illustrating a first receiver and a first shift register included in the data driver of FIG. 6. FIG. 8 is a diagram illustrating an operation of the first receiver of FIG. 7.

Referring to FIG. 7, the data driver (e.g., the data driver 300 of FIG. 6) may include the first receiver 400 and the first shift register 450. The first receiver 400 of FIG. 7 may correspond to the first receiver 310 of FIG. 6 and the first shift register 450 of FIG. 7 may correspond to the first shift register 320 of FIG. 6. The second receiver 315 and the second shift register 325 included in the data driver 300 of FIG. 6 may have the same structure as the first receiver 400 and the first shift register 450 of FIG. 7.

The first receiver 400 may include a pattern detector 410, a first folding control signal generator 420, an analog front end block (AFE) 440, and a first switch 430.

The pattern detector 410 may detect the pattern of the first data packet DATA1 provided from the timing controller. The pattern detector 410 may detect the pattern of the first data packet DATA1, which is a differential signal that swings between a high level and a low level.

The first folding control signal generator 420 may generate the first folding control signal CTLF1 based on the folding pattern and the pattern of the first data packet DATA1. In some example embodiments, the first folding control signal generator 420 may compare the pattern of the first data packet DATA1 to the folding pattern. For example, when the pattern of the first data packet DATA1 is the same as the folding pattern, the first folding control signal generator 420 may determine that the first display area is folded and may generate the first folding control signal CTLF1. In other example embodiments, when the first data packet DATA1 does not swing between the high level and the low level during a set or predetermined time, the first folding control signal generator 420 may determine that the first display area is folded. Referring to FIG. 8, the first folding control signal generator 420 may determine that the first display area is unfolded because the first data packet DATA1 regularly swings between the high level (e.g., "P") and the low level (e.g., "N") during a first period P1. The first folding control signal generator 420 may determine that the first display area is folded because the first data packet DATA1 does not swing between the high level and the low level more than the set or predetermined time Tp in a second period P2. The first folding control signal generator 420 may determine that the first display area is unfolded because the first data packet DATA1 regularly swings between the high level and the low level during a third period P3. The first folding control signal generator 420 may output the first folding control signal CTLF1 to the analog front end block 440 of the first receiver 400 and the clock data recovery (CDR) block 470 of the first shift register 450.

The first data packet DATA1 provided to the first receiver 400 may output to the first shift register 450 through the analog front end block 440. The power line that provides the power signal Vp to the analog front end block 440 may be coupled to the analog front end block 440 through the first switch 430. The first switch 430 may turn on or turn off in response to the first folding signal CTLF1. When the first display area is unfolded, the first switch 430 may be turned on in response to the first folding control signal CTLF1. Thus, the first data packet DATA1 may output through the analog front end block 440 of the first receiver 400. When the first display area is folded, the first switch 430 may be turned off in response to the first folding control signal CTLF1. Thus, the first data packet DATA1 may not output from the first receiver 400.

The first shift register 450 of the data driver may include the clock data recovery block 470. The power line that provides the power signal Vp to the clock data recovery block 470 may be coupled to the clock data recovery block 470 through the second switch 460. The second switch 460 may turn on or turn off in response to the first folding control signal CTLF1. When the first display area is unfolded, the second switch 460 may be turned on in response to the first folding control signal CTLF1. Thus, the first pulses PL1 may output from the clock data recovery block 470 of the first shift register 450. When the first display area is folded, the second switch 460 may be turned off in response to the first folding control signal CTLF1. Thus, the clock data recovery block 470 of the first shift register 450 may not be driven and the first pulses PL1 may not output.

The second receiver and the second shift register of the data driver may have the same structure as the first receiver 400 and the first shift register 450 and may be operated in the same method as the first receiver 400 and the first shift register 450. When the second display area is unfolded, the second receiver may output the second data packet. When the second display area is folded, the second receiver may not output the second data packet. When the second display area is unfolded, the second shift register may output the second pulses PL2. When the second display area is folded, the second shift register may not output the second pulses PL2.

Figure 9:
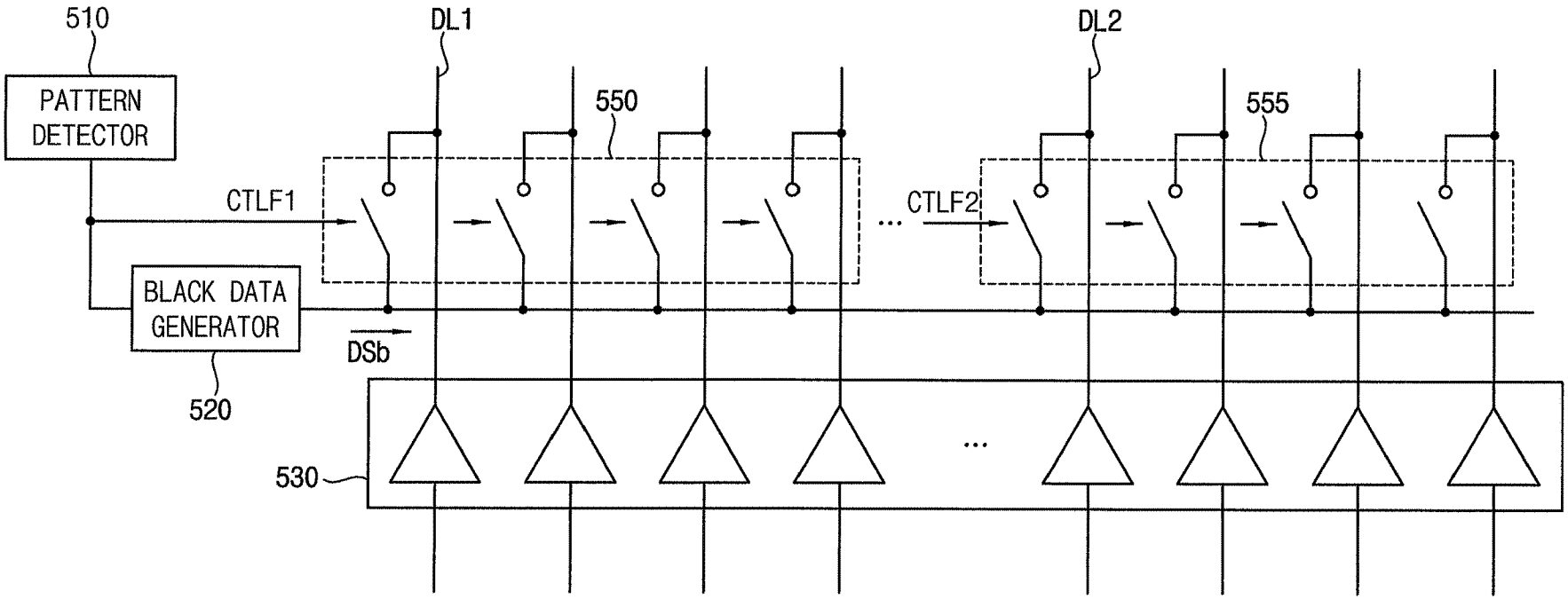
FIG. 9 is a diagram illustrating an operation of a black data generator included in the data driver of FIG. 6.

FIG. 9 is a diagram illustrating an operation of a black data generator included in the data driver of FIG. 6.

Referring to FIG. 9, the data driver (e.g., the data driver 300 of FIG. 6) may include the black data generator 520, a first switch block 550, and a second switch block 555.

The black data generator 520 may generate the black data signal DSb corresponding to the black color in response to the first folding control signal CTLF1 provided from the pattern detector 510 of the first receiver (e.g. the first receiver 310 of FIG. 6) or the second folding control signal CTLF2 provided from the pattern detector of the second receiver (e.g., the second receiver 315 of FIG. 6). When one of the first display area and the second display area is folded, the black data generator 520 may generate the black data signal DSb.

The first switch block 550 may be coupled between the black data generator 520 and the first data lines DL1 in the first display area. The first switch block 550 may be turned on or turned off in response to the first folding control signal CTLF1.

The second switch block 555 may be coupled between the black data generator 520 and the second data lines DL2 in the second display area. The second switch block 555 may be turn on or turned off in response to the second folding control signal CTLF2.

Referring to FIG. 9, the output buffer 530 of the data driver may be coupled to the first data lines DL1 formed in the first display area and the second data lines DL2 formed in the second display area.

When the first display area is folded, the first data packet may not output from the first receiver of the data driver or the first pulses PL1 may not output from the first shift register of the data driver. Thus, the first data signal may not output from the output buffer 530. The black data generator 520 may generate the black data signal DSb in response to the first folding control signal CTLF1. The first switch block 550 may be turned on in response to the first folding control signal CTLF1. Thus, the black data signal DSb may be provided to the first data lines DL1.

When the second display area is folded, the second data packet may not output from the second receiver of the data driver or the second pulses may not output from the second shift register of the data driver. Thus, the second data signal may not output from the output buffer 530. The black data generator 520 may generate the black data signal DSb in response to the second folding control signal CTLF2. The second switch block 555 may turn on in response to the second folding control signal CTLF2. Thus, the black data signal DSb may be provided to the second data lines DL2.

Figure 10:
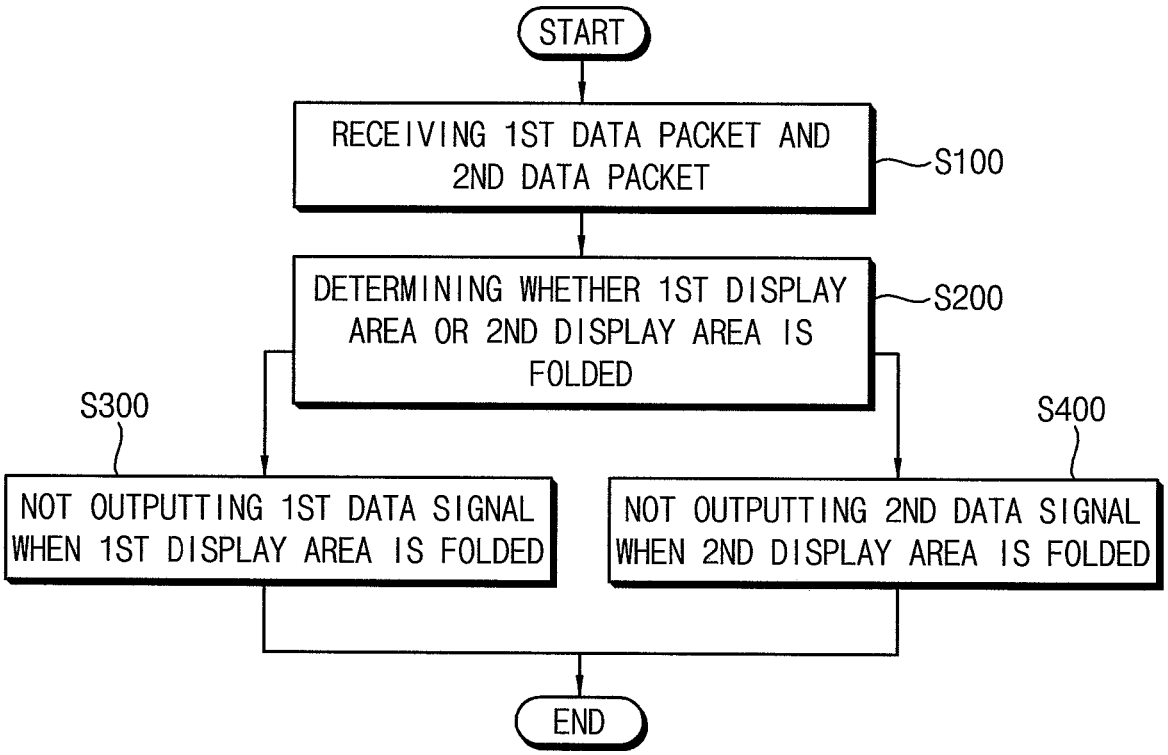
FIG. 10 is a flowchart illustrating a driving method of a foldable display device according to example embodiments.

FIG. 10 is a flowchart illustrating a driving method of a foldable display device according to example embodiments.

Referring to FIG. 10, a driving method of a foldable display device may include an operation of receiving a first data packet (e.g., DATA1) and a second data packet (e.g., DATA2) concurrently S100, an operation of determining whether a first display area or a second display area of a display panel is folded based on the first data packet and the second data packet S200, an operation of not outputting a first data signal (e.g., DS1) corresponding to the first data packet when the first display area is folded S300, and an operation of not outputting a second data signal (e.g., DS2) corresponding to the second data packet when the second display area is folded S400.

The driving method of the foldable display device may receive the first data packet and the second data packet concurrently S100. A data driver (e.g., the data driver 120 of FIG. 1 or the data driver 300 of FIG. 6) of the foldable display device may receive the first data packet from a timing controller (e.g., the timing controller 140 of FIG. 1) through the first port and the second data packet from the timing controller through a second port.

The driving method of the foldable display device may determine whether the first display area or the second display area is folded based on the first data packet and the second data packet S200. The driving method of the foldable display device may detect a pattern of the first data packet based on the first data packet. In some example embodiments, the driving method of the foldable display device may compare the pattern of the first data packet to a set or predetermined folding pattern and may determine that the first display area is folded when the pattern of the first data packet is the same as the folding pattern. In other example embodiments, the driving method of the foldable display device may determine that the first display area is folded when the first data packet does not swing during a set or predetermined time. The driving method of the foldable display device may detect a pattern of the second data packet based on the second data packet. In some example embodiments, the driving method of the foldable display device may compare the pattern of the second data packet to the set or predetermined folding pattern and determine that the second display area is folded when the pattern of the second data packet is the same as the folding pattern. In other example embodiments, the driving method of the foldable display device may determine that the second display area is folded when the second data packet does not swing during the set or predetermined time.

The driving method of the foldable display device may not output the first data signal corresponding to the first data packet when the first display area is folded S300. In some example embodiments, the driving method of the foldable display device may block a power of an analog front end block of a first receiver and not output the first data packet to a first shift register when the first display area is folded. In other example embodiments, the driving method of the foldable display device may block a power of a clock data recovery block (e.g., CDR 470 of FIG. 7) of the first shift register (e.g., the first shift register 450 of FIG. 7) and not output the first pulses PL1 corresponding to the first data packet when the first display area is folded. Thus, the first data signal may not be provided to the first display area.

The operation of not outputting the first data signal corresponding to the first data packet may further include an operation of providing a black data signal corresponding to black color to the data lines formed in the first display area. When the first display area is folded, the data driver may provide the black data signal to the data lines formed in the first display area instead of the first data signal.

The driving method of the foldable display device may not output the second data signal corresponding to the second data packet when the second display area is folded S400. In some example embodiments, the driving method of the foldable display device may block a power of an analog front end block of a second receiver and not output the second data packet to a second shift register when the second display area is folded. In other example embodiments, the driving method of the foldable display device may block a power of a clock data recovery block of the second shift register and not output the second pulses corresponding to the second data packet when the second display area is folded. Thus, the second data signal may not be provided to the second display area.

The operation of not outputting the second data signal corresponding to the second data packet may further include an operation of providing the black data signal corresponding to the black color to the data lines formed in the second display area. When the second display area is folded, the data driver may provide the black data signal to the data lines formed in the second display area instead of the second data signal.

As described above, the driving method of the foldable display device may detect a folding state of the first display area and the second display area, may not output the first data signal corresponding to the first data packet when the first display area is folded, and may not output the second data signal corresponding to the second data packet when the second display area is folded. Thus, power consumption of the foldable display device may be reduced.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present disclosure". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. When an element or layer is referred to as being "directly on", "directly connected to", "directly coupled to", or "immediately adjacent to" another element or layer, there are no intervening elements or layers present.

The foregoing is illustrative of example embodiments and is not to be construed as limiting thereof. Although a few example embodiments have been described, those skilled in the art will readily appreciate that many modifications are possible in the example embodiments without materially departing from the novel teachings and aspects of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A foldable display device comprising:

a display panel comprising a first display area, a second display area, and a folding area between the first display area and the second display area, the first display area and the second display area being configured to be folded or unfolded with respect to the folding area;

a timing controller configured to receive input image data and to provide a first data packet corresponding to the first display area and a second data packet corresponding to the second display area concurrently; and a data driver configured to receive the first data packet and the second data packet, to determine whether the first display area or the second display area is folded with respect to the folding area based on the first data packet and the second data packet, and to not output a first data signal corresponding to the first data packet or a second data signal corresponding to the second data packet when the first display area or the second display area is folded with respect to the folding area.

2. The foldable display device of claim 1, wherein the data driver comprises:

a first receiver configured to receive the first data packet and to detect whether the first display area is folded based on the first data packet;

a second receiver configured to receive the second data packet and to detect whether the second display area is folded based on the second data packet;

a first shift register configured to output first pulses based on the first data packet; and a second shift register configured to output second pulses based on the second data packet.

3. The foldable display device of claim 2, wherein the first receiver comprises:

a pattern detector configured to detect a pattern of the first data packet; and a folding control signal generator configured to determine whether the first display area is folded based on the pattern of the first data packet and to output a folding control signal based on a folding state of the first display area.

4. The foldable display device of claim 3, wherein the folding control signal generator is configured to generate the folding control signal based on the pattern of the first data packet and a folding pattern.

5. The foldable display device of claim 3, wherein the first receiver comprises a switch coupled between an analog front end (AFE) block and a power line through which a power signal is provided.

6. The foldable display device of claim 3, wherein the first shift register comprises a switch coupled between a clock data recovery (CDR) block and a power line through which a power signal is provided.

7. The foldable display device of claim 2, wherein the second receiver comprises:

a pattern detector configured to detect a pattern of the second data packet; and a folding control signal generator configured to determine whether the second display area is folded based on the pattern of the second data packet and to output a folding control signal based on a folding state of the second display area.

8. The foldable display device of claim 7, wherein the folding control signal generator is configured to generate the folding control signal based on the pattern of the second data packet and a folding pattern.

9. The foldable display device of claim 7, wherein the second receiver comprises a switch coupled between an analog front end (AFE) block and a power line through which a power signal is provided.

10. The foldable display device of claim 7, wherein the second shift register comprises a switch coupled between a clock data recovery (CDR) block and a power line through which a power signal is provided.

11. The foldable display device of claim 2, wherein the data driver further comprises:

a black data generator configured to generate a black data signal corresponding to black color;

a first switch block configured to couple the black data generator to data lines in the first display area when the first display area is folded; and a second switch block configured to couple the black data generator to data lines in the second display area when the second display area is folded.

12. The foldable display device of claim 11, wherein the first switch block and the second switch block are configured to turn on or turn off in response to a folding control signal.

13. The foldable display device of claim 11, wherein the black data signal is provided to the data lines in the first display area when the first display area is folded, and the black data signal is provided to the data lines in the second display area when the second display area is folded.

14. A driving method of a foldable display device, the method comprising:

receiving a first data packet and a second data packet concurrently;

determining whether a first display area or a second display area of a display panel is folded with respect to a folding area between the first display area and the second display area;

not outputting a first data signal corresponding to the first data packet when the first display area is folded with respect to the folding area; and not outputting a second data signal corresponding to the second data packet when the second display area is folded with respect to the folding area.

15. The driving method of claim 14, wherein the determining whether the first display area of the display panel is folded comprises detecting a pattern of the first data packet based on the first data packet.

16. The driving method of claim 14, wherein the determining whether the second display area of the display panel is folded comprises detecting a pattern of the second data packet based on the second data packet.

17. The driving method of claim 14, wherein the not outputting the first data signal corresponding to the first data packet comprises blocking a power signal provided to a first receiver that receives the first data packet or to a first shift register coupled to the first receiver.

18. The driving method of claim 14, wherein the not outputting the second data signal corresponding to the second data packet comprises blocking a power signal provided to a second receiver that receives the second data packet or to a second shift register coupled to the second receiver.

19. The driving method of claim 14, wherein the not outputting the first data signal corresponding to the first data packet further comprises providing a black data signal corresponding to black color to data lines in the first display area.

20. The driving method of claim 14, wherein the not outputting the second data signal corresponding to the second data packet further comprises providing a black data signal corresponding to black color to data lines in the second display area.

* * * * *